US006531851B1

(12) United States Patent
Lenk et al.

(10) Patent No.: US 6,531,851 B1
(45) Date of Patent: Mar. 11, 2003

(54) LINEAR REGULATOR CIRCUIT AND METHOD

(75) Inventors: Ronald J. Lenk, Sunnyvale, CA (US); Nazzareno Rossetti, Danville, CA (US)

(73) Assignee: Fairchild Semiconductor Corporation, South Portland, ME (US)

( * ) Notice: Subject to any disclaimer, the term of this patent is extended or adjusted under 35 U.S.C. 154(b) by 0 days.

(21) Appl. No.: 09/972,235

(22) Filed: Oct. 5, 2001

(51) Int. Cl.[7] ..... G05F 1/40
(52) U.S. Cl. ..... 323/280; 323/282
(58) Field of Search ..... 323/273, 275, 323/279, 280, 282, 285

(56) References Cited

U.S. PATENT DOCUMENTS 5,191,278 A * 3/1993 Carpenter ..... 323/273
5,477,132 A * 12/1995 Canter et al. ..... 323/282
5,559,424 A * 9/1996 Wrathall et al. ..... 323/277
6,369,554 B1 * 4/2002 Aram ..... 323/282

* cited by examiner

*Primary Examiner*—Matthew Nguyen
(74) *Attorney, Agent, or Firm*—Skjerven Morrill LLP

(57) ABSTRACT

A linear regulator circuit includes an input terminal for receiving an input voltage and an output terminal for providing an output voltage. A pass device, coupled to the input terminal and the output terminal, generates an output current. A feedback circuit is coupled to the pass device and the output terminal. The feedback circuit increases the output voltage as the output current decreases and decreases the output voltage as the output current increases.

20 Claims, 4 Drawing Sheets

LINEAR REGULATOR CIRCUIT AND METHOD

TECHNICAL FIELD OF THE INVENTION

The present invention relates generally to the field of voltage regulators, and more particularly, to a linear regulator circuit and method.

BACKGROUND OF THE INVENTION

Many direct current (DC) electronic devices, such as integrated circuits and microprocessors, require a constant voltage within certain tolerances. The task of providing this voltage is made difficult by the small fluctuations in a voltage generator, and by the variation in load current required by the DC device.

One type of circuit that can be used to provide a constant voltage is a linear regulator. A linear regulator may have a capacitor connected to its output terminal at which the output voltage appears. This capacitor——which can be a discrete component, separate from the linear regulator——functions to stabilize the output voltage when the load current changes rapidly. The suitability of a certain capacitor for this application is governed by two characteristics: its capacitance value, and its equivalent series resistance (ESR) value. The capacitance is a measure of the amount of charge a capacitor can hold. The equivalent series resistance (ESR) value of a capacitor affects how current is supplied by the capacitor, and how quickly it can respond to variations in load current. In a linear regulator implemented according to previously developed techniques, it is desirable to have a capacitor with a high value of capacitance and a low value of ESR. Such capacitors, however, can be relatively large and expensive. This drives up the total cost for providing a constant voltage. It also causes more power to be consumed, and requires more physical space to implement.

SUMMARY OF THE INVENTION

The disadvantages of and problems associated with previously developed linear regulators have been substantially reduced or eliminated using the present invention.

According to one embodiment of the present invention, a linear regulator circuit includes an input terminal for receiving an input voltage and an output terminal for providing an output voltage. A pass device, coupled to the input terminal and the output terminal, generates an output current. A feedback circuit is coupled to the pass device and the output terminal. The feedback circuit increases the output voltage as the output current decreases and decreases the output voltage as the output current increases.

According to another embodiment of the present invention, a method for providing a regulated voltage includes: receiving an input voltage; generating an output voltage and an output current; increasing the output voltage as the output current decreases; and decreasing the output voltage as the output current increases.

According to yet another embodiment of the present invention, a linear regulator circuit includes an input terminal for receiving an input voltage and an output terminal for providing an output voltage. A current sensing device is connected to at least one of the input terminal and the output terminal. The current sensing device senses a current flowing in the linear regulator circuit. A gain amplifier generates a voltage proportionate to the current. An adder combines the output voltage and the voltage output by the gain amplifier. An error amplifier, which may be coupled to the adder and the pass device, causes an increase in the output voltage as the current decreases and causes a decrease in the output voltage as the current increases.

BRIEF DESCRIPTION OF THE DRAWINGS

For a more complete understanding of the present invention and for further embodiments, aspects, and advantages, reference is now made to the following description taken in conjunction with the accompanying drawings, in which.

DETAILED DESCRIPTION OF THE PREFERRED EMBODIMENTS

The preferred embodiments of the present invention and their advantages are best understood by referring to FIGS. 1 through 4 of the drawings. Like numerals are used for like and corresponding parts of the various drawings.

According to embodiments of the present invention, the output voltage of a power supply is adjusted proportionately to a current flowing in a linear regulator circuit. As the current increases, the output voltage is lowered. As the current decreases, the output voltage is raised. In a sense, the linear regulator has a finite impedance, so that the output voltage changes as the current changes. The concept or technique of adjusting the voltage at some node according to current flow is commonly known as "droop". With this technique, a smaller capacitor can be used with the linear regulator, thus reducing the overall cost. It also requires less power and requires less physical space for providing a regulated voltage.

Figure 1:
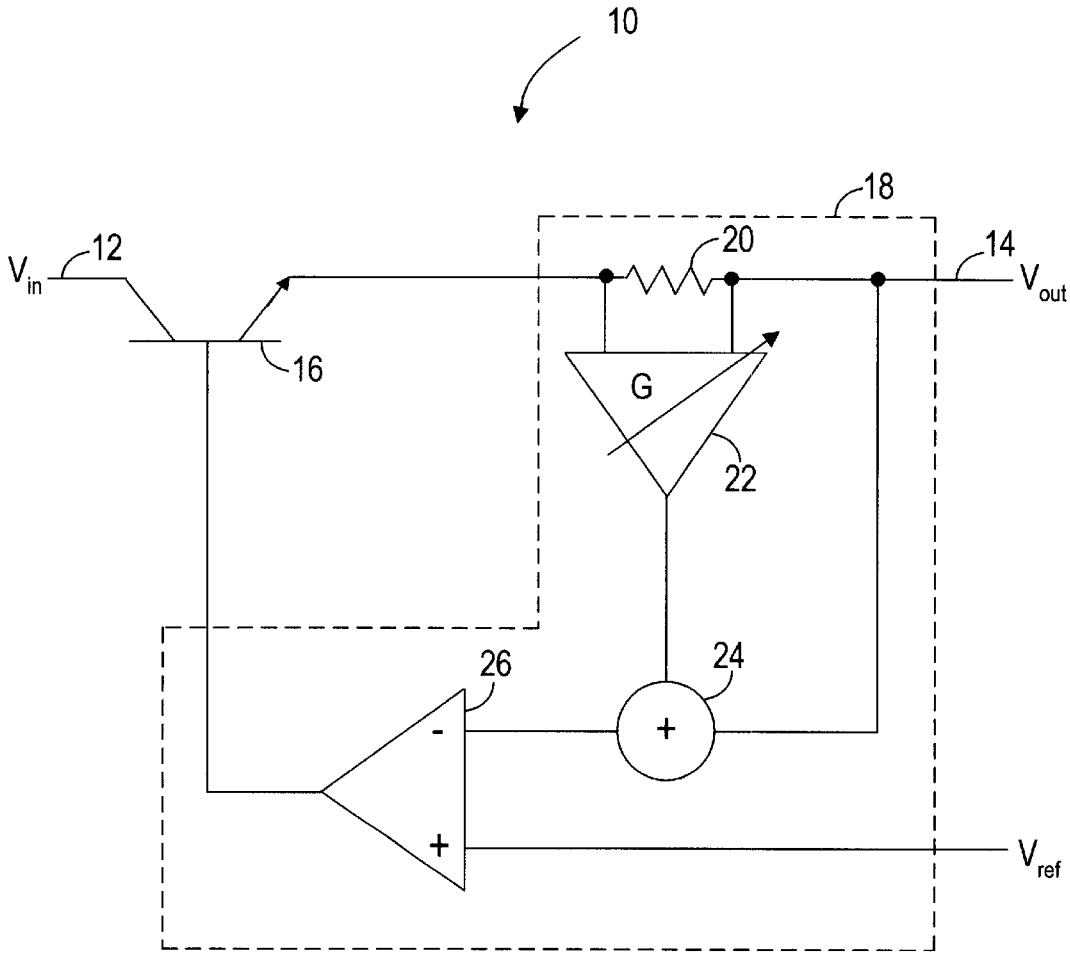
FIG. 1 is a schematic diagram, in partial block form, of a linear regulator circuit, in accordance with an embodiment of the present invention.

FIG. 1 is a schematic diagram, in partial block form, of a linear regulator circuit 10, in accordance with an embodiment of the present invention. This linear regulator circuit 10 can be implemented as or incorporated in an integrated circuit chip or semiconductor device which can be coupled with a discrete capacitor (not shown) to provide a regulated voltage to an electronic device. The electronic device may require a DC voltage within certain tolerances. These tolerances represent the limits at which the electronic device can function. For example, if the voltage drops below a certain level, it may be insufficient to trigger circuit elements in the electronic device, or, if the voltage rises above another level, it may damage elements in the electronic device. These tolerances are typically represented as percentages of an "ideal voltage", for example, 5 V ±5%. As depicted, linear regulator circuit 10 includes an input terminal 12, an output terminal 14, a pass device 16, and a feedback circuit 18.

The input terminal 12 can be coupled to a power source, which produces an input voltage $V_{in}$ for linear regulator circuit 10. As used herein, the terms "connected", "coupled", or any variant thereof means any connection or coupling, either direct or indirect, between two or more elements. An output voltage $V_{out}$ for linear regulator circuit 10 appears at output terminal 14. In one embodiment, the value of input voltage $V_{in}$ can be larger than the regulated value of output voltage $V_{out}$ because of losses in linear regulator circuit 10 during voltage regulation. The output terminal 14 can be coupled to an electronic device. A capacitor (not shown) may be coupled at output terminal 14 to stabilize the output voltage $V_{out}$ of linear regulator circuit 10. According to an embodiment of the present invention, linear regulator circuit 10 provides a well-regulated voltage, while using a smaller capacitor as compared to previously developed linear regulator devices.

Pass device 16 is coupled between the input terminal 12 and the output terminal 14. As depicted, pass device 16 may comprise, inter alia, a bi-polar junction transistor (BJT). In other embodiments, pass device 16 may comprise any other suitable device, such as a metal-oxide semiconductor field-effect transistor (MOSFET). Current flows from pass device 16 to output terminal 14.

The feedback circuit 18 is coupled to the output terminal 14 and the pass device 16. Generally, the feedback circuit 18 senses or measures a current in linear regulator circuit 10, and drives the pass device 16 according to the value of the sensed current and the reference voltage. As the current increases, the feedback circuit 18 causes the output voltage $V_{out}$ to decrease, and as the current decreases, the feedback circuit 18 causes the output voltage $V_{out}$ to increase. In this embodiment, the feedback circuit 18 drives pass device 16 in response to the current flowing from pass device 16 to the output terminal 14. When the feedback circuit 18 drives the pass device 16 harder, more current flows to output terminal 14, which ultimately causes the output voltage $V_{out}$ to increase. When the feedback circuit 18 drives the pass device 16 less, less current flows from the pass device, which ultimately causes the output voltage $V_{out}$ to decrease. This maintains the value of the output voltage $V_{out}$ within the tolerances necessary for a particular application. Unlike previously developed techniques, the output voltage $V_{out}$ is adjusted in response to current.

In one embodiment, the feedback circuit 18 comprises a current sensing device 20, a gain amplifier 22, an adder 24, and an error amplifier 26. The current sensing device 20 is coupled between the pass device 16 and the output terminal 14, and can be implemented with a resistor, as shown. This resistor may have a relatively small resistance value to minimize the amount of power dissipated. The voltage drop across the resistor varies according to the output current, and thus current sensing device 20 can be used to sense the amount of current flowing to the output terminal 14. The gain amplifier 22 is coupled to the current sensing device 20 and amplifies this voltage drop. Thus, the voltage output by the gain amplifier 22 is greater for larger currents and less for smaller currents. The amount of gain provided by gain amplifier 22 can be adjustable.

Adder 24 is coupled to gain amplifier 22. The output voltage of the gain amplifier 22 is added to the output voltage $V_{out}$ by adder 24. The adder 24 is coupled to an inverting input of the error amplifier 26. A non-inverting input of error amplifier 26 receives a reference voltage $V_{ref}$. The error amplifier 26 is coupled to and drives pass device 16, thus controlling the current output therefrom. If the value of the output voltage $V_{out}$ in combination with the output of gain amplifier 22 at the inverting input of error amplifier 26 is less than the value of the reference voltage $V_{ref}$ at its non-inverting input, the pass device 16 is driven harder. Alternatively, if the value of the output voltage $V_{out}$ in combination with the output of gain amplifier 22 at the inverting input of error amplifier 26 is greater than the value of the reference voltage $V_{ref}$ at its non-inverting input, the pass device 16 is driven less.

When the load current is constant, the error amplifier 26 drives the base of pass device 16 according to the difference between the output voltage $V_{out}$ and the reference voltage $V_{ref}$. As the load current varies, the voltage from the gain amplifier 22 also varies, thus changing the voltage at the inverting input of the error amplifier 26. A smaller output current causes the error amplifier 26 to drive the pass device 16 harder. A larger output current causes the error amplifier 26 to drive the pass device 16 less. Thus, if the load is initially low and suddenly increases, the potential stored in the capacitor (not shown) is above the ideal voltage, and the stored energy is provided to stabilize the output voltage $V_{out}$.

In this way, linear regulator circuit 10 compensates for voltage fluctuations of input voltage $V_{in}$ at the input terminal 12, as well as load fluctuations in the electronic device. In one embodiment, the output voltage $V_{out}$ of linear regulator circuit 10 may be lower than ideal under high loading conditions so that if the load suddenly becomes light, the output voltage $V_{out}$ has further to rise before it exceeds the upper tolerance. Likewise, the output voltage $V_{out}$ may be higher than ideal under low loading conditions so that if the load suddenly becomes heavy, the output voltage $V_{out}$ has further to fall before it drops below the lower tolerance. Thus, when the load current changes suddenly, the power is supplied to or stored by the discrete capacitor (not shown) until the linear regulator circuit 10 adjusts. The ESR value of the capacitor may not be so great that during the transition period the voltage will fall below or rise above error tolerances.

As the capacitor supplies the power to the electronic device, the output voltage $V_{out}$ can fall below the potential stored in the capacitor according to its ESR value. The invention, therefore, by increasing the output voltage $V_{out}$ under low loading conditions, effectively increases the error tolerances of the circuit.

For example, consider a linear regulator circuit 10 with an initial output current of 0.1 Amps, where 0.1 Amps is a low load current. Assume that the electronic device coupled to circuit 10 requires an ideal voltage, 5.0 V, plus or minus 5%. The initial output voltage $V_{out}$ can be 5.0 V plus 4%, or 5.2 V, since the output voltage may be greater than the ideal voltage under low loading conditions. The capacitor is charged to 5.2 V. If the load current rapidly increases to 1.0 Amps, where 1.0 Amps is a high load current, substantially more current flows through current sensing device 20. Accordingly, gain amplifier 22 outputs a higher voltage. This causes error amplifier 26 to drive the pass device 16 less, which, in turn, reduces the current flowing to output terminal 14. Thus, the output voltage $V_{out}$ is regulated.

In a linear regulator circuit implemented according to previously developed techniques, the circuit's output voltage, and the capacitor's potential would be at the ideal voltage, and the capacitor would supply at least 5.0 V minus 5%, or 4.75 V. In this example, the greatest possible value of the ESR of the capacitor would be 250 milliohms. At 250 milliohms, 1.0 amps flowing from the capacitor yields a voltage drop of 0.25 V.

However, according to the present invention, the capacitor in this example can have a voltage drop of 9% of the ideal voltage. Thus, the greatest possible value of the ESR of the capacitor in this example would be 450 milliohms. At 450 milliohms, 1.0 amps flowing from the capacitor yields a voltage drop of 0.45 V, dropping the output voltage from 5.2 V to 4.75 V. Thus, compared to previously developed techniques, the same size capacitor can provide more margin for the tolerances. It follows also that the same margin, as compared with previously developed techniques, can be achieved by circuits and methods of the present invention using a smaller capacitor.

Figure 2:
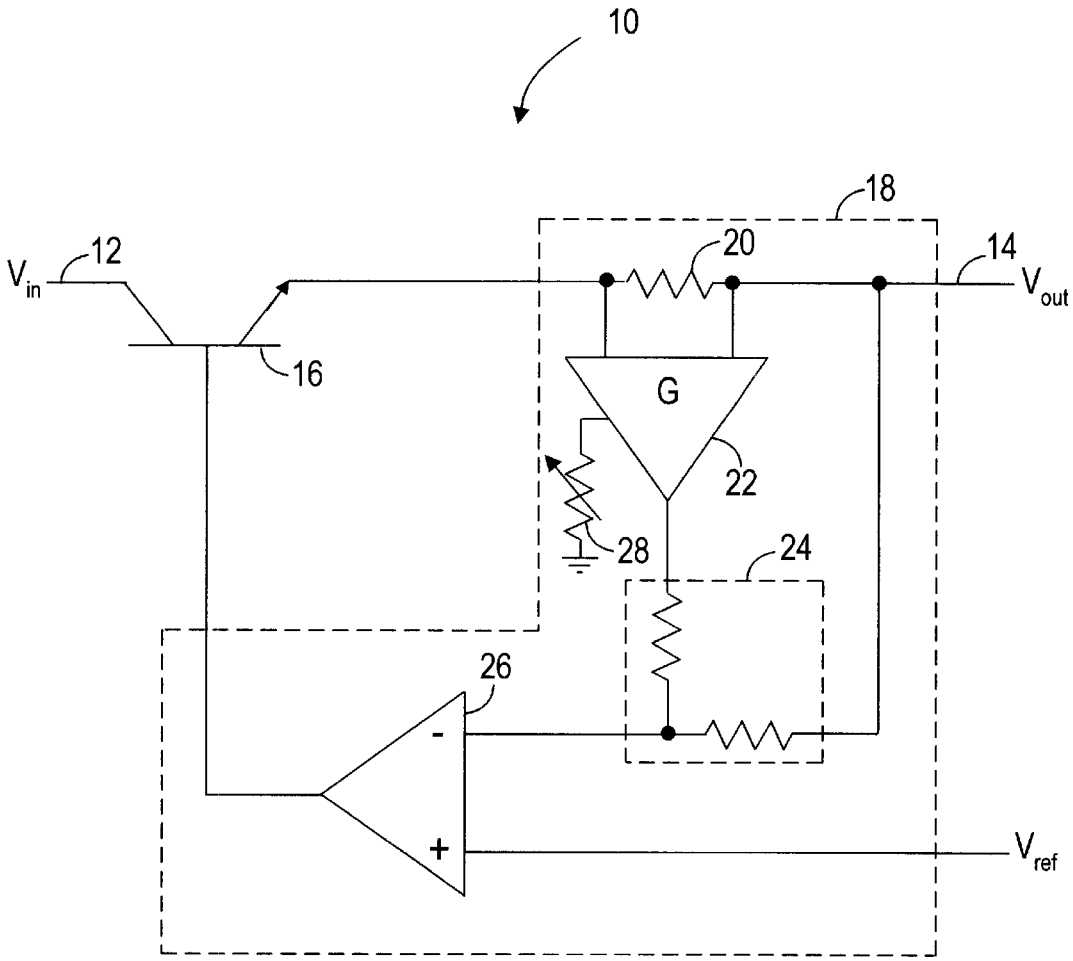
FIG. 2 is a schematic diagram of an exemplary implementation for the linear regulator circuit shown in FIG. 1.

FIG. 2 is a schematic diagram of an exemplary implementation for the linear regulator circuit 10 shown in FIG. 1. As depicted, the adder 24 comprises two resistors: one coupled between the output terminal of gain amplifier 22 and the inverting input terminal of error amplifier 26, the other coupled between the output terminal 14 and the inverting input terminal of amplifier 26. As in FIG. 1, the adder 24 is also coupled to a inverting input of the error amplifier 26.

The amount of gain provided by gain amplifier 22 can be fixed or adjustable. As depicted, the amount of gain provided by gain amplifier 22 depends on the resistance value of an adjustable resistor 28. Thus, the resistance value of resistor 28 can be changed to produce different gains for different applications. In one embodiment, this linear regulator circuit 10 can be implemented as or incorporated in an integrated circuit chip or semiconductor device, while resistor 28 can be a separate, discrete component, thus facilitating the adjustment of gain provided by gain amplifier 22.

Figure 3:
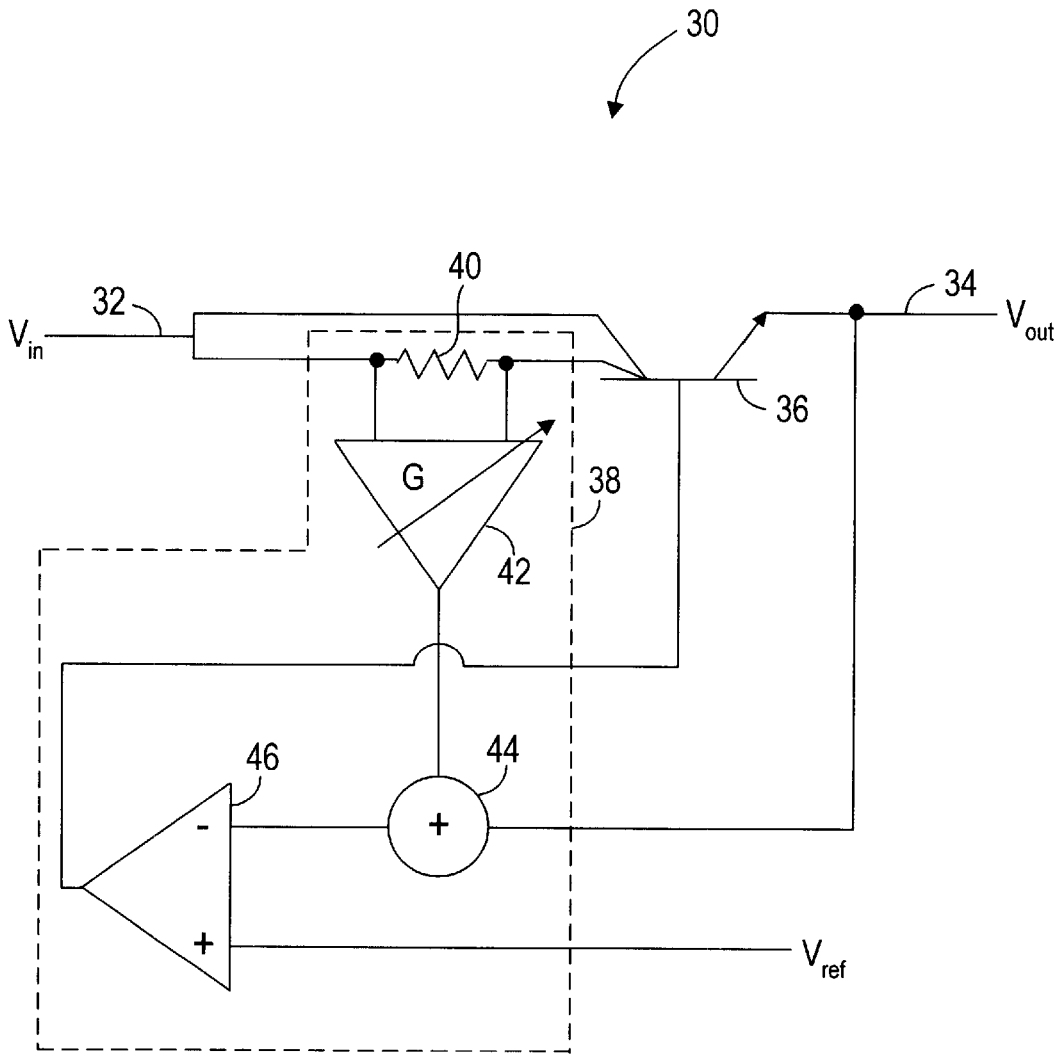
FIG. 3 is a schematic diagram, in partial block form, of a linear regulator circuit, in accordance with another embodiment of the present invention.

FIG. 3 is a schematic diagram, in partial block form, of a linear regulator circuit 30, in accordance with another embodiment of the present invention. This linear regulator circuit 30 comprises an input terminal 32, an output terminal 34, and a feedback circuit 38.

A capacitor (not shown) may be coupled at output terminal 34 to stabilize the output voltage $V_{out}$ of linear regulator circuit 30. According to an embodiment of the present invention, linear regulator circuit 30 provides a well-regulated voltage, while using a smaller capacitor as compared to previously developed linear regulator devices.

Pass device 36 is coupled between the input terminal 32 and the output terminal 34. As depicted, pass device 36 may comprise, inter alia, a BJT having multiple collectors. In other embodiments, pass device 36 may comprise any other suitable device, such as a MOSFET. Current may flow from input terminal 32 into pass device 36.

The feedback circuit 38 is coupled to the input terminal 32, the output terminal 34 and the pass device 36. In this embodiment, the feedback circuit 38 drives pass device 36 in response to the current flowing from the input terminal 32 to the pass device 36. When the feedback circuit 38 drives the pass device 36 harder, the output voltage $V_{out}$ increases. When the feedback circuit 38 drives the pass device 36 less, the output voltage $V_{out}$ decreases.

In one embodiment, the feedback circuit 38 comprises a current sensing device 40, a gain amplifier 42, an adder 44, and an error amplifier 46. The current sensing device 40 is coupled between the input terminal 32 and the pass device 36, and may have a relatively small resistance value to minimize the amount of power dissipated. The voltage across the current sensing device 40 varies according to the input current, and thus current sensing device 40 can be used to sense the amount of current flowing from the input terminal 32. The gain amplifier 42 is coupled to the current sensing device 40 and amplifies this voltage drop. Thus, the voltage output by the gain amplifier 42 is greater for larger currents and less for smaller currents. In one embodiment, the amount of gain provided by gain amplifier 42 can be adjustable.

Adder 44 is coupled to gain amplifier 42. The output voltage of the gain amplifier 42 is added to an output voltage $V_{out}$ by adder 44. The adder 44 is coupled to an inverting input of the error amplifier 46. A non-inverting input of error amplifier 46 receives a reference voltage $V_{ref}$. The error amplifier 46 is coupled to and drives pass device 36, thus controlling the current output therefrom, and thus the output voltage $V_{out}$. If the value of the output voltage $V_{out}$ in combination with the output of gain amplifier 42 at the inverting input of error amplifier 46 is less than the value of the reference voltage $V_{ref}$ at its non-inverting input, the pass device 36 is driven harder, thus causing the output voltage $V_{out}$ to increase. Alternatively, if the value of the output voltage $V_{out}$ in combination with the output of gain amplifier 42 at the inverting input of error amplifier 46 is greater than the value of the reference voltage $V_{ref}$ at its non-inverting input, the pass device 36 is driven less, thus causing the output voltage $V_{out}$ to decrease.

Figure 4:
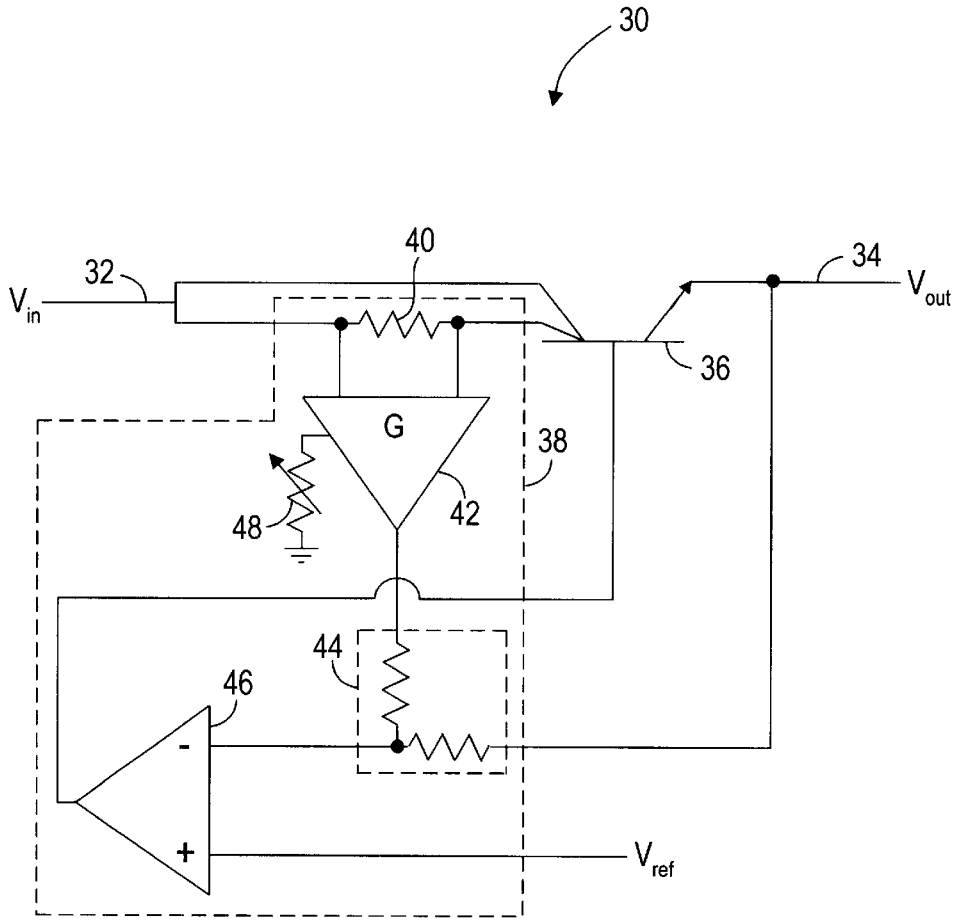
FIG. 4 is a schematic diagram of an exemplary implementation for the linear regulator circuit shown in FIG. 3.

FIG. 4 is a schematic diagram of an exemplary implementation for the linear regulator circuit 30 shown in FIG. 3. As depicted, the adder 44 comprises two resistors: one coupled between the output terminal of gain amplifier 42 and the inverting input terminal of error amplifier 46, the other coupled between the output terminal 34 and the inverting input terminal of amplifier 46. As in FIG. 3, the adder 44 is also coupled to an inverting input of the error amplifier 46.

The amount of gain provided by gain amplifier 42 can be fixed or adjustable. As depicted, the amount of gain provided by gain amplifier 42 depends on the resistance value of an adjustable resistor 48. Thus, the resistance value of resistor 48 can be changed to produce different gains for different applications. In one embodiment, this linear regulator circuit 30 can be implemented as or incorporated in an integrated circuit chip or semiconductor device, while resistor 48 can be a separate, discrete component, thus facilitating the adjustment of gain provided by gain amplifier 42.

While particular embodiments of the present invention have been shown and described, it will be obvious to those skilled in the art that changes and modifications may be made without departing from this invention in its broader aspects, and, therefore, the appending claims are to encompass within their scope all such changes and modifications as fall within the true spirit and scope of this invention.

What is claimed is:

1. A linear regulator circuit comprising:

an input terminal for receiving an input voltage;

an output terminal for providing an output voltage;

a pass device coupled to the input terminal and the output terminal, the pass device operable to generate an output current; and a feedback circuit coupled to the pass device and the output terminal, the feedback circuit operable to increase the output voltage as the output current decreases and to decrease the output voltage as the output current increases, wherein the feedback circuit comprises:

a gain amplifier operable to generate a voltage proportionate to the output current; an adder operable to combine the output voltage and the voltage generated by the gain amplifier; and an error amplifier coupled to the adder, a reference voltage, and the pass device.

2. The linear regulator circuit of claim 1, wherein the adder comprises a first resistor coupled between the gain amplifier and an input terminal for the error amplifier, and a second resistor coupled between the output voltage and an input terminal for the error amplifier.

3. The linear regulator circuit of claim 1, wherein the pass device comprises a transistor.

4. The linear regulator circuit of claim 1, wherein the transistor is a bipolar transistor.

5. The linear regulator circuit of claim 3, wherein the transistor is a MOSFET.

6. The linear regulator circuit of claim 1, wherein a resistor is coupled to the pass device.

7. The linear regulator circuit of claim 1, wherein the gain amplifier has a fixed gain.

8. The linear regulator circuit of claim 1, wherein the gain amplifier has an adjustable gain.

9. The linear regulator circuit of claim 8, wherein the gain of the amplifier is adjusted with a variable resistance.

10. The linear regulator circuit of claim 1, wherein the linear regulator circuit is implemented as an integrated circuit.

11. A method for providing a regulated voltage, the method comprising:

receiving an input voltage;

generating an output voltage and an output current;

increasing the output voltage as the output current decreases; and decreasing the output voltage as the output current increases;

wherein increasing and decreasing comprises:

generating a voltage proportionate to the output current; and combining the output voltage and the voltage proportionate to the output current.

12. A linear regulator circuit comprising:

an input terminal for receiving an input voltage;

an output terminal for providing an output voltage;

a current sensing device connected to at least one of the input terminal and the output terminal, the current sensing device operable to sense a current flowing in the linear regulator circuit;

a gain amplifier operable to generate a voltage proportionate to the current;

an adder operable to combine the output voltage and the voltage output by the gain amplifier; and an error amplifier coupled to the adder, a reference voltage, and the pass device, the error amplifier operable to cause an increase in the output voltage as the current decreases and to cause a decrease in the output voltage as the current increases.

13. The linear regulator circuit of claim 12, wherein the pass device is a transistor.

14. The linear regulator circuit of claim 13, wherein the transistor is a bipolar transistor.

15. The linear regulator circuit of claim 13, wherein the transistor is a MOSFET.

16. The linear regulator circuit of claim 12, wherein the adder comprises a first resistor coupled between the gain amplifier and an input terminal for the error amplifier, and a second resistor coupled between the output voltage and an input terminal for the error amplifier.

17. The linear regulator circuit of claim 12, wherein the gain amplifier has a fixed gain.

18. The linear regulator circuit of claim 12, wherein the gain amplifier has adjustable gain.

19. The linear regulator circuit of claim 18, wherein the gain of the amplifier is adjusted with a variable resistance.

20. The linear regulator circuit of claim 12, wherein the linear regulator circuit is implemented as an integrated circuit.

* * * * *